United States Patent [19]

McKie et al.

[11] Patent Number: 4,855,171

[45] Date of Patent: Aug. 8, 1989

[54] SIGN-MAKING MATERIALS

[75] Inventors: Peter McKie, Challock; Kenneth W. A. Elcock, Hythe, both of England

[73] Assignee: Esselte Pendaflex Corporation, Garden City, N.Y.

[21] Appl. No.: 41,823

[22] Filed: Apr. 23, 1987

[30] Foreign Application Priority Data

Apr. 25, 1986 [GB] United Kingdom ..... 8610114

[51] Int. Cl.[4] ..... B44C 1/17

[52] U.S. Cl. ..... 428/40; 156/240; 428/43; 428/914

[58] Field of Search ..... 428/40, 914, 43; 156/240, 249; 8/468

[56] References Cited

U.S. PATENT DOCUMENTS

| | | | |
|---|---|---|---|
| 3,359,127 | 12/1967 | Meyer et al. | 428/914 X |
| 3,806,397 | 4/1974 | Kukoff | 428/40 |
| 3,854,229 | 12/1974 | Morgan | 428/40 X |
| 3,920,499 | 11/1975 | Day et al. | 428/914 X |
| 3,922,445 | 11/1975 | Mizuno et al. | 428/914 X |
| 4,023,292 | 5/1977 | Shibata et al. | 428/40 X |
| 4,225,641 | 9/1980 | Yokomizo | 428/914 X |
| 4,542,078 | 9/1985 | Fitzer et al. | 428/914 |
| 4,594,276 | 6/1986 | Relyea | 428/40 |
| 4,692,198 | 9/1987 | Borresen | 428/914 X |

FOREIGN PATENT DOCUMENTS

| | | | |
|---|---|---|---|
| 2847702 | 5/1980 | Fed. Rep. of Germany | 428/914 |
| 0061594 | 4/1982 | Japan | 428/914 |
| 1097467 | 1/1968 | United Kingdom | 428/914 |

*Primary Examiner*—Henry F. Epstein

*Attorney, Agent, or Firm*—Darby & Darby

[57] ABSTRACT

Sign-making materials are described which may be cut on a computer controlled sign cutting machine and then used to make subsurface signs, i.e. signs in which the legend is viewed through a transparent or translucent sign sheet. The sign-making material consists of a carrier with successively on it an adhesive layer, a film layer and a dye- or pigment-containing layer. The last of these adheres to the back of the sign sheet under heat and pressure. The first two may subsequently be removed, e.g. by using the adhesive to adhere the film layer to a sheet of material more strongly than the film layer is adhered to the dye- or pigment-containing layer, and then pulling the sheet of material away. The material enables the satisfactory production of very professional looking signs quickly and easily using standard computer controlled vinyl cutting machines, which are widely available in commerce, and a simple heated roller nip.

7 Claims, No Drawings

SIGN-MAKING MATERIALS

This invention relates to sign-making materials.

Dry transfer materials have been known for the manufacture of signs for many years. They consist essentially of a transparent or translucent backing sheet, a design releasably adhered to such backing sheet, and overlaying at least the design, a layer of an adhesive which will serve to adhere the design to a desired receptor surface. Such transfer materials are conventionally made by printing processes, with the transferrable design being applied to the carrier sheet by printing and subsequently over-printed or over-coated with adhesive. Because of the way they are made, it is not common to manufacture "one off" dry transfers.

Instead, dry transfers are usually produced in large runs, and if to be used e.g. for making a sign from individual letters, the user has to transfer individual letters sequentially from a dry transfer sheet. Such sequential transfer takes time, and requires skill to do it satisfactorily, particularly in order to achieve optically satisfactory alignment and spacing.

An alternative approach to manufacturing signs is to cut the desired sign legend from a film stock material. A number of commercially available machines for doing this have come on to the market in recent years, most notably the "Graphix" machines made by Gerber Scientific Instruments. Such machines selectively cut through a plastics film layer held via a permanently tacky adhesive to a release coated backing, the cutting being effected under computer control. Such machines enable a complete legend to be cut on such stock material, whereafter the waste plastics film, i.e. that not constituting part of the legend, is removed, and the legend then applied where desired.

The standard stock material consists of a release coated backing sheet having adhered thereto by a permanently tacky pressure sensitive adhesive a thin vinyl film. Once cut and waste stripped, the user is provided with a right reading legend (i.e. it is not in mirror writing as viewed) which must then be picked off the release coated backing and readhered in its desired final position. In order to achieve this without disturbing the relative positions of the individual components of the legend, a so-called pre-mask tape may be used. This is a strip of transparent or translucent film material bearing a coating of pressure sensitive adhesive. The pressure sensitive adhesive is of such a kind that it will stick to the vinyl film and pull the vinyl portions forming the legend away from the release coated backing sheet, but will not stick to receptor surfaces as well as the adhesive destined to stick the pieces of vinyl film to those receptor surfaces. The legend may accordingly be applied to the receptor surface by positioning the pre-mask tape bearing the legend over the receptor surface, pressing the whole of the pre-mask tape and the legend which it bears into contact with the receptor surface and then peeling away the pre-mask tape, whereon the individual elements of the legend are left on the surface, as they adhere thereto more strongly than the pre-mask tape adheres to the vinyl film.

The use of pre-mask tape is cumbersome and inconvenient, and it would be more convenient if this step could be avoided. This can of course be done by cutting the legend in the stock material in a mirror image fashion i.e. so that it is not right reading, with the stock material having an adhesive coating on its outside enabling the cut out legend to be directly adhered to the desired receptor surface. Products of this nature have been commercially offered, but they do not work well.

An alternative approach to sign-making is to produce a legend, e.g. using a dry transfer material, on a temporary carrier and then transfer that legend up to the back of a translucent or transparent sign sheet, as described for example in British Patent Specification No. 2005596A. Such a system works well, though it suffers from requiring the user to be able to produce a satisfactory legend using a dry transfer material.

It is possible to pre-cut vinyl stock material as noted above and then adhere the vinyl to the rear face of a transparent or translucent sign sheet. This does not always give satisfactory results, however, both due to the difficulty of adhering the vinyl appropriately and due to the fact that the vinyl stock materials are often fairly thick, and accordingly the individual elements of the legend cannot be easily backed up, e.g. by a coloured background as described in Specification No. 2005596A. Nevertheless, the use of a computer controlled cutting machine with the rear surface sign-making approach described in Specification No.2005596A provides a workable system.

We have now found that considerably improved results may be obtained by using as the stock material fed through such a computer controlled cutting machine, a material in which the cut goes through several layers, the outermost of which may be adhered under the action of heat and pressure to the rear surface of a transparent or translucent sign sheet, the remaining layers then being removable.

Thus according to a first feature of the present invention there is provided a sign-making material consisting of a carrier sheet carrying successively:

1. a layer of adhesive releasably peelable from the carrier sheet,
2. a film layer adhered to the carrier sheet by the adhesive layer and of sufficient strength that it may be peeled from the carrier sheet,
3. a dye- and/or pigment-containing layer capable of adhering, under the action of heat and pressure, to a transparent or translucent sign sheet.

Such a material may be used in a cutting machine with the cutter set to cut through all three layers. Once cutting has been achieved, because the second layer is sufficiently strong to enable it to be peeled from the carrier sheet, peeling of all three layers outside the desired legend may take place to leave the individual cutout elements of the legend on the carrier sheet, each with its dye- or pigment-containing layer outward. The carrier sheet may then be located where desired relative to a transparent or translucent sign sheet which is to receive the legend, with the individual elements of the legend in contact with the sign sheet, and adequate heat and pressure applied to the assembly to make layer 3 adhere to the sign sheet surface. The carrier sheet may then simply be peeled away to leave the legend on the rear surface of the sign sheet in the desired position. The elements may be left in place as such, but it is usually preferred to formulate the material to enable the adhesive and film layers to be removed, leaving the legend delineated solely by areas of the dye- or pigment-containing layer 3. Provided the adhesive is appropriately formulated, this may be done by adhering a sheet of material, e.g. under heat and pressure, to the adhesive, and then peeling it away leaving only areas of layer 3 on the sign sheet.

Within the general configuration described above, much variation may be made. It is convenient to consider the individual components separately:

Carrier sheet

Any flexible carrier material may be used consistent with practicality. It should desirably be dimensionally stable, to facilitate handling, and in web form if it is to be used on a commercially available machine of the type described above. Conveniently it is in the form of a strip or a roll of paper or film stock having suitable perforations or sprocket holes along its edges, for engagement with the drive mechanism of the machine in question. Papers are convenient and inexpensive materials, though dimensionally stable plastics films, for example polyethylene terephthalate films, may be used.

The surface of the carrier must be chosen relative to the adjacent adhesive layer such as to enable clean peeling of the layers from it. Although this may be achieved with certain systems where the carrier is a plastics film without any particular treatment of the plastics film, it is more reliable to coat the surface of the carrier with an appropriate release coating. Numerous release coatings for both paper and plastics films are available in commerce and are widely used. An appropriate release coating may be chosen without difficulty from the variety available.

Adhesive layer

The adhesive layer may vary widely in composition and properties. It is of course necessary that the adhesive is of sufficient strength to enable it to hold layers 2 and 3 on the carrier sheet. This can be achieved using quite low adhesive power or low tack adhesives, though higher tack adhesives should be used if the release properties of the surface of the carrier sheet are high.

Preferably the adhesive is fairly strong, either a fairly tacky pressure sensitive adhesive or a heat-activated adhesive which will adhere more strongly to a suitable sheet of material than the bond between layers 2 and 3. A variety of polymer based adhesives is suitable, for example, acrylic polymer based adhesives of high tack or low tack polybutene based adhesives.

Film layer

This layer is preferably a thin tough polymeric film. It has to be peelable away from the carrier sheet, and accordingly must possess the necessary film strength to enable that to occur. The material of choice is a cellulosic film, e.g. a cellulose diacetate film. Other types of film layers available in commerce may be used. If desired, the film layer may be formed of two or more layers which together constitute the film layer, e.g. a laminate of two plastics films or a coated plastics film.

Dye- or pigment-containing layer

This layer is the layer which imparts visibility to the legend. It consists generally of an appropriate polymeric film-forming vehicle into which has been incorporated a pigment and/or dye to give visibility. Various film-forming materials may be used as a base for this layer. The layer must of course be capable of adhering appropriately a sign sheet. Preferably this is achieved by using a thermoplastic resin as a base, for example a vinyl polymer. The dye or pigment-containing layer may if desired be made up of a plurality of successive dye- or pigment-containing layers.

The following example will serve to illustrate the invention.

EXAMPLE 1

A roll of cellulose diacetate film (ex Lonza-Werke GmbH, 30 microns thick, and having a gloss finish one side and a mechanically matted finish the other side) was taken and coated with a coloured coating composition consisting of (parts by weight)

| | |
|---|---|
| polyvinyl butyral (Pioloform BL18, ex Wacker-Chemie GmbH ) | 18.8 parts |
| 74OP methylated spirits | 75.5 parts |
| carbon black pigment | 5.7 parts |

The composition had been ball milled for at least 12 hours to ensure a good dispersion.

The coating was carried out using a Meyer bar to give, after drying at 50° C. for 25 seconds a dry coating weight of 4 to 6 grams per square meter.

The uncoated side of the colour coated acetate film is was then adhesed and laminated to a siliconised paper support.

The adhesive used was a thermoplastic acrylic copolymer pressure sensitive adhesive supplied as a 40% by weight solids solution in ethyl acetate/toluene (Durotak 180–2404, ex National Adhesives) diluted 1:1 by weight with ethyl acetate.

Coating was carried out using a Meyer bar to achieve, after drying at 50° C. for 25 seconds, a dry coating weight of 5–7 grams per square meter. The adhesive was then laminated to the gloss side of a proprietary siliconised paper (Perlasic, ex Perlisco Export Packaging, PapierFabrik Perlen, Switzerland). The paper consists of 120 grams (wood free) base paper which has a 20 gsm gloss low density polyethylene on one side and a 20 gsm matt polyethylene on the other side. The gloss side is siliconised which allows the assembly of acetate film, coating and adhesive to be peeled cleanly away.

Following lamination, the material was slit into 86mm or 308mm wide strips, provided with standard perforations along the edges of each strip and the perforated strips rolled.

The rolled strips so produced were sized for use in conventional fashion in Gerber Scientific Instruments Graphix 2 and 4 machines, and were cut using such machines to produce desired legends. Viewed from the layer-bearing side, the legend read in right reading fashion. Once each legend had been produced, the excess material was easily hand stripped from the carrier film, and letter centres or islands were likewise stripped, and the carrier was then positioned appropriately, relative to a transparent sign sheet of 5mm thick polymethyl methacrylate. The legend was transferred to the rear surface of this sheet by simply passing the carrier sheet and sign sheet through a nip between a pair of silicone rubber covered rollers (nip gap 2.5mm, temperature of heated upper roller 150°–170° C). After passing through the nip, the carrier sheet was pulled away to leave the individual elements of the legend appropriately positioned on the surface of the sign sheet, each element consisting of, in register, a black polyvinyl butyral based layer adhered to the surface of the sign sheet, the cellulose diacetate layer and the layer of adhesive thereover.

Such a product constitutes a sign, and can be used as such or e.g. with a spray coating of paint on its rear surface to provide a coloured background against which the black legend shows up.

It is however preferred to remove the cellulose diacetate and adhesive and this may simply be done by taking a sheet of suitable film material, e.g. a sheet of acetate film, and placing that over the legend and passing the two sheets so assembled through the heated nip again. This adheres the acetate sheet to the adhesive, giving a sandwich which, when peeled apart, fails adhesively at the bond between the polyvinyl butyral based layer and the glossy side of the cellulose diacetate film. Thus, when the acetate sheet is peeled off, it takes away the adhesive and cellulose diacetate film sections to leave the legend in black on the rear surface of the sign sheet and constituted solely by the polyvinyl butyral based composition. This is a very thin layer and the appropriate background colour for the sign may now be easily applied by passing the polymeththyl methacrylate sheet bearing the legend through the heated nip again, this time in contact with some form of hot blocking foil which will serve to block colour onto the rear surface of the sign sheet in the areas between and over the black areas defining the legend. Sheets of product for such purpose are available commercially under the Trade Mark SignColor and are manufactured by Esselte Letraset Ltd. at Ashford, Kent.

EXAMPLE 2

In this example, the film layer consists of a coated cellulose diacetate film.

Cellulose diacetate film as used in Example 1 was coated on its gloss side with a clear layer of polyvinyl butyral. The coating composition used for this consisted of 10 parts by weight of polyvinyl butyral (Pioloform BL18 ex Wacker-Chemie GmbH) and 90 parts by weight of 74OP methylated spirits. The polyvinyl butyral was simply dissolved in methylated spirits to form the coating composition using high speed stirring.

This coating composition was coated on the cellulose diacetate film using a Meyer bar and the coating dried at 60° to 70° C. for about 25 seconds. The coating weight was 3 to 4 grams polyvinyl butyral per square meter.

The coated side of the cellulose diacetate film was then overcoated with a plasticised nitrocellulose composition consisting of the following ingredients in the following proportions by weight.

| | |
|---|---|
| Cellulose nitrate (27% isopropanol damped by weight solution in 50–50 by weight mixture of xylene and ethyl acetate) | 77.00 |
| Polymer plasticiser (Paraplex G25 ex Rohm & Haas) | 13.00 |
| Carbon black pigment | 5.6 |
| Flow control agent (Modaflow, ex Monsanto Chemicals Ltd) | 0.3 |
| Ethyl acetate | 4.1 |

The composition had been ball milled for 24 hours to ensure dispersion of the carbon black.

This coating composition was applied using a Meyer bar to give after drying at 60° to 70° C. a coating weight of 4to 5 grams per square meter.

The so coated cellulose diacetate film was then adhesed on its uncoated side and laminated to a siliconised paper support as in Example 1. The material was then slit and could be used satisfactorily.

EXAMPLE 3

In this example, the film layer is a cellulose diacetate film as before and it bears two successively applied pigmented layers.

Example 2 was repeated save that instead of the unpigmented polyvinyl butyral coating on the gloss side of the cellulose diacetate film there was used a pigmented coating formed by Meyer bar coating a composition consisting of the following ingredients in the following proportions by weight:

| | |
|---|---|
| Polyvinyl butyral (Pioloform BS18 ex Wacker-Chemie GmbH) | 9.4 parts |
| 74OP methylated spirits | 84.9 parts |
| Carbon black pigment | 5.7 parts |

The coating composition was ball milled for 24 hours prior to use to give good dispersion of the carbon black.

After application using a Meyer bar the coating composition was dried at 60° to 70° C. to give a coating weight of 3 to 4 grams per square meter of pigmented polyvinyl butyral.

Similar satisfactory results as in Example 2 were obtained.

We claim:

1. A sign-making material consisting of a carrier sheet carrying successively:

(1) a layer of adhesive releasably peelable from the carrier sheet, (2) a film layer adhered to the carrier sheet by the adhesive layer and of sufficient strength that it may be peeled from the carrier sheet, (3) a dye- and/or pigment-containing layer capable of adhering, under the action of heat and pressure, to a transparent or translucent sign sheet.

2. The sign-making material of claim 1 wherein the carrier sheet is a release-coated dimensionally stable plastics film.

3. The sign-making material of claim 1 wherein the adhesive layer is a fairly tacky pressure sensitive adhesive or a heat-activated adhesive which will adhere more strongly to a suitable sheet of material than the bond between layers 2 and 3.

4. The sign-making material of claim 1 wherein the film layer 2 is a cellulosic film.

5. The sign-making material of claim 1 wherein the dye or pigment-containing layer 3 is a thermoplastic resin vehicle into which has been incorporated a pigment and/or dye to give visibility.

6. A method of making a sign which comprises cutting the sign-making material of claim 1 in a cutting machine with the cutter set to cut through all three layers, peeling all three layers outside the desired legend from the carrier sheet to leave the individual cutout elements of the legend on the carrier sheet, each with its dye- or pigment-containing layer outward, locating the carrier sheet where desired relative to a transparent or translucent sign sheet which is to receive the legend, with the individual elements of the legend in contact with the sign sheet, applying adequate heat and pressure to the assembly to make layer 3 adhere to the sign sheet surface, and peeling away the carrier sheet to leave the legend on the rear surface of the sign sheet in the desired position.

7. Sign making material comprising a flexible carrier sheet a release layer coated on said carrier sheet, a layer of pressure sensitive adhesive that is peelable from the release layer on the carrier sheet, a film layer adhered to the carrier sheet by said adhesive layer, said film layer having sufficient integrity to be peeled away from the release layer on the carrier sheet, and a colored layer containing a member selected from the group consisting of a dye or a pigment on said film layer, said colored layer being capable of adhering under the action of heat and pressure to a transparent or translucent sign sheet and the bond between said adhesive layer and said film layer being stronger than the bond between said film layer and said colored layer.

* * * * *